US010196787B2

(12) United States Patent
van Eijl et al.

(10) Patent No.: US 10,196,787 B2
(45) Date of Patent: Feb. 5, 2019

(54) SELF-DRIVEN ICE RESURFACING MACHINE AND METHOD FOR USE

(71) Applicants: Paul J van Eijl, Fountain City, WI (US); Dave van Eijl, Elgin, MN (US)

(72) Inventors: Paul J van Eijl, Fountain City, WI (US); Dave van Eijl, Elgin, MN (US)

( * ) Notice: Subject to any disclaimer, the term of this patent is extended or adjusted under 35 U.S.C. 154(b) by 0 days.

(21) Appl. No.: 15/342,683

(22) Filed: Nov. 3, 2016

(65) Prior Publication Data

US 2017/0073915 A1 Mar. 16, 2017

Related U.S. Application Data

(62) Division of application No. 14/192,012, filed on Feb. 27, 2014, now Pat. No. 9,512,579.

(60) Provisional application No. 61/769,987, filed on Feb. 27, 2013.

(51) Int. Cl.
*E01H 4/02* (2006.01)

(52) U.S. Cl.
CPC ..... *E01H 4/023* (2013.01)

(58) Field of Classification Search
CPC ..... E01H 4/023
See application file for complete search history.

(56) References Cited

U.S. PATENT DOCUMENTS

| | | | | |
|---|---|---|---|---|
| 5,204,814 | A * | 4/1993 | Noonan | A01D 34/008 180/168 |
| 7,765,724 | B2 * | 8/2010 | Walker | E01H 4/023 37/219 |
| 8,972,052 | B2 * | 3/2015 | Chiappetta | G05D 1/0225 700/245 |
| 2002/0156556 | A1 * | 10/2002 | Ruffner | A01B 69/008 701/23 |
| 2004/0068352 | A1 * | 4/2004 | Anderson | A01B 69/008 701/25 |
| 2009/0000323 | A1 * | 1/2009 | Walker | E01H 4/023 62/235 |
| 2011/0295420 | A1 * | 12/2011 | Wagner | G05D 1/0225 700/245 |

* cited by examiner

*Primary Examiner* — Matthew D. Troutman
(74) *Attorney, Agent, or Firm* — Gutwein Law; Greg N. Geiser

(57) ABSTRACT

A self-driven device to resurface an ice rink. The device includes a rotating brush to sweep the ice anterior to a blade used to the scrape the ice. Collected snow is moved into a hot water tank where it is melted and moved to a warm water tank for redeposit onto the skating surface.

4 Claims, 4 Drawing Sheets

SELF-DRIVEN ICE RESURFACING MACHINE AND METHOD FOR USE

CROSS REFERENCE TO RELATED APPLICATIONS

This application is a divisional of U.S. patent application Ser. No. 14/192,012, filed 2014 Feb. 27 now pending and which claims the benefit of provisional patent application Ser. No. 61/769,987 filed 2013 Feb. 27 by Paul J. van Eijl, one of the present inventors, and is herein incorporated by reference in its entirety.

FEDERALLY SPONSORED RESEARCH OR DEVELOPMENT

Not applicable

SEQUENCE LISTING, A TABLE, OR A COMPUTER PROGRAM

Not applicable

FIELD OF THE INVENTION

The present invention relates to a self-driven device to resurface an ice rink.

BACKGROUND OF THE INVENTION

A traditional ice-resurfacing machine is constructed on a vehicle chassis and operated by a user. The ice-resurfacing vehicle typically has a large storage area for collected ice shavings and includes an ice-resurfacing unit dragged behind the vehicle and around the ice needing to be resurfaced. This resurfacing unit includes a blade, augers, and watering unit. In use, the ice-resurfacing vehicle is driven onto the rink, the ice-resurfacing unit is lowered and the vehicle is driven along areas of ice needing to be resurfaced. In operation, as the vehicle is driven, the ice resurfacing unit blade shaves the ice surface with the augers collecting the shaved ice and depositing it within the storage area while the watering unit applies fresh water to the shaved ice.

A standard ice resurfacing vehicle is quite large, often the size of a large automobile, making it cumbersome to maneuver and operate. A majority of the size of the ice-resurfacing vehicle is comprised of the storage area. This storage area typically occupies the front of the vehicle and functions a depository for removed shaved ice. After the completion of resurfacing, this shaved ice must be emptied from the storage area and then melted or deposited outside for complete disposal.

In addition to being difficult to operate, traditional ice resurfacers are slow. A typical ice resurfacing is completed in approximately 7-10 minutes. Using two resurfacers at a time can lesson the time to resurface the ice, but still takes approximately 4-6 minutes. As ice time is a valuable commodity in terms of both practice time and money, ice-resurfacing time needs to be minimized.

Due to these limitations, an ice-resurfacing unit is desired that can quickly resurface the ice, does not require an operator, and does not require the storage of shaved ice. Preferably, this ice-resurfacing unit is used in combination with several other similar units to quickly enter an ice surface and resurface the ice in a very short period to quickly and efficiently restore the ice surface.

SUMMARY OF THE INVENTION

A self-driven ice-resurfacing device for resurfacing an ice rink is disclosed. The device is comprised of several individual components contained within an exterior housing. The housing extends a width, a length, and a height of the device to enclose the components. These components operate in combination to provide an efficient and effective ice resurfacing by brushing the ice, scraping the ice, heating collected ice shavings to reduce bulk and recycle the ice shavings, filtering the heated ice shavings, and depositing this filtered, heated, and recycled water back onto the ice surface at a smooth and consistent rate of flow.

To accomplish this process, these several systems are powered by a motor and a fuel source. The fuel source is preferably electric in the form of a battery or batteries, although the fuel source could be any standard low emissions fuel such as propane, natural gas, hydrogen, or even provided by plugging into a standard electric household current.

This fuel source and motor will power all of the systems of the device. The major mechanical systems of the device will be a brush, drive wheels, heating elements, water pump, navigation controls, and watering unit. In addition to the mechanical systems, the device includes a blade, a water filter unit, and a pair of water storage tanks; one containing warm water and one containing hot water.

The device is movable across and onto the ice surface via the drive wheels. In the preferred embodiment of the present invention, at least three drive wheels are movable and powered by the motor. Although the motor is preferred, it is anticipated that the wheels could be powered by individual motors or a rotary motor located within a hub of the wheels. Preferably, the wheels are located near a rear of the device and below the water storage tanks and to support the weight of the device and equally spaced across the width of the device. The wheels may include studded tires to provide traction to the device as it navigates the ice surface.

A front of the device will include the brush. The brush is cylindrical and rotates in clockwise direction along a width of the device. The brush includes a plurality of stiff bristles to contact the ice surface and sweep snow off of the ice and to move it towards the water storage tanks rear of the device.

The blade is located adjacent to the brush opposite the font of the device and includes a leading edge to scrape the ice surface. The blade is mounted in an angular fashion to be in frictional communication with the ice surface to shave and scrape worn ice. The depth of the blade can be adjusted to cut deeper into the ice surface.

The blade is mounted on the warm water tank. The warm water tank has an exterior with an angular shape in line with the leading edge of the blade and aligned with the brush, wherein the angular shape acts as a modified incline plane to move snow off of the ice surface and into the hot water tank. The hot water tank is positioned adjacent and on top of the warm water tank and includes an opening to receive ice shavings. The warm water tank contains water to be placed onto the ice surface for resurfacing. In the preferred embodiment of the present invention, the warm water tank will have a capacity of approximately ninety-one (91) gallons and maintains water at a temperature of one hundred-sixty degrees Fahrenheit (160° F.). A thermostat and a water heater maintain this preferred temperature.

Preferably, the hot water tank has a capacity of approximately sixty-three (63) gallons and maintains water at a temperature of two hundred-ten degrees Fahrenheit (210° F.). The high temperature of the hot water tank aids in melting snow as it is added to the hot water tank. Melting is furthered by the hot spray of water from a nozzle powered by the water pump. As snow enters the hot water tank, the nozzle delivers a steady spray of hot water to melt the snow, which is deposited into the hot water tank.

Water is moved from the hot water tank to the warm water tank to allow for the regulation of the temperature and replenish water into the warm water tank used for resurfacing. To facilitate clean water, a water filter is located inline with the connection between the hot water tank and warm water tank, wherein hot water is filtered prior to entering into the warm water tank. The water filter can remove impurities, debris, and particulates generated from the melted snow deposited into the hot water tank.

Water exiting the warm water tank will be placed on the ice with the watering unit. The watering unit will evenly distribute warm water onto the ice at the rear of the device. The flow of water placed onto the ice is controlled and further distributed with a trailing mat. Preferably, the watering unit contains a plurality of apertures extending the width of the device and utilizes a flow meter and gravity to control the flow of water from the watering unit and warm water tank onto the ice surface.

The directional control and location of the device on the ice surface is controlled by the internal electronic components of the device in communication with the navigation controls. Preferably, the device will utilize the global positioning system (GPS) to navigate the ice surface, although the various patterns can be directly programmed into the device, the device could follow an indicator placed above or below the ice surface, or the device could be remote controlled by a user.

In use, the device will enter the ice surface using the wheels and aligning itself perpendicularly with the length of the ice sheet. The wheels are movable in multiple directions and driven by the motor to facilitate this movement. The device will then travel around the perimeter of the ice sheet in a pattern to resurface worn ice. As the device travels, the brush will clean the ice prior to the blade scraping the ice, with the brush and shape of the warm water tank helping to move snow into the hot water tank. Simultaneous to the brushing and scraping, snow will enter the hot water tank where it is melted with the nozzle and filtered and transferred to the warm water tank as need. Additionally, the watering unit will be depositing fresh water onto the ice. As the device moves around the rink, snow will be continuously melted and added to the hot water tank and recycled into the warm water tank.

In the preferred embodiment, multiple devices will be used in tandem to resurface the ice quickly. In the preferred embodiment of the present invention, four devices are used at a time to resurface the ice within a couple of minutes. Accordingly, the devices are sized to be installed into existing infrastructure, such as bays and garages, for quick entry onto and off of the ice surface. Preferably, the devices are stored on a rack quickly moved into position on the ice.

Accordingly, the preferred materials used on the device are corrosion resistant and resilient with the preferred material stainless steel, although other similar materials may be used. The preferred size of the device is an operational width of eleven (11) feet and a depth of approximately three (3) feet. This allows for storage of multiple devices within existing infrastructure. Although, the use of multiple devices is preferred for quick resurfacing, one device does have the capacity and capability to resurface an entire hockey rink.

BRIEF DESCRIPTION OF THE SEVERAL VIEWS OF THE DRAWING (S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
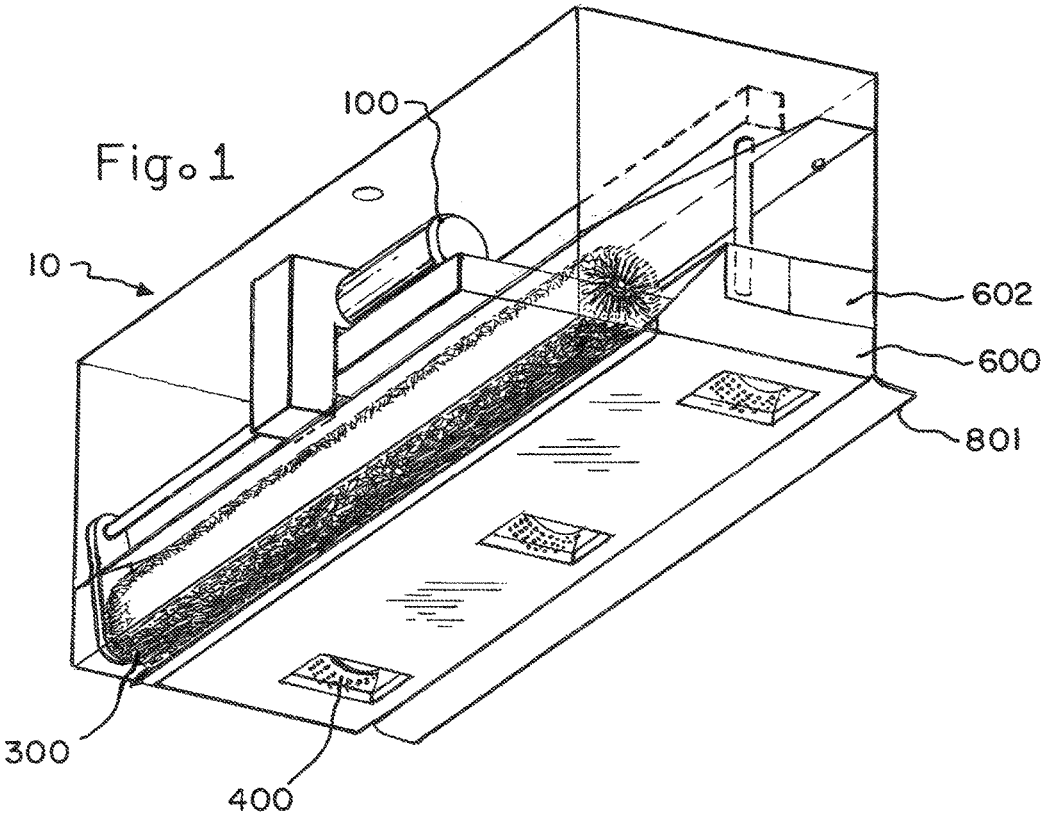
FIG. 1 is an isometric bottom side view of the device, according to the present invention.
Figure 2:
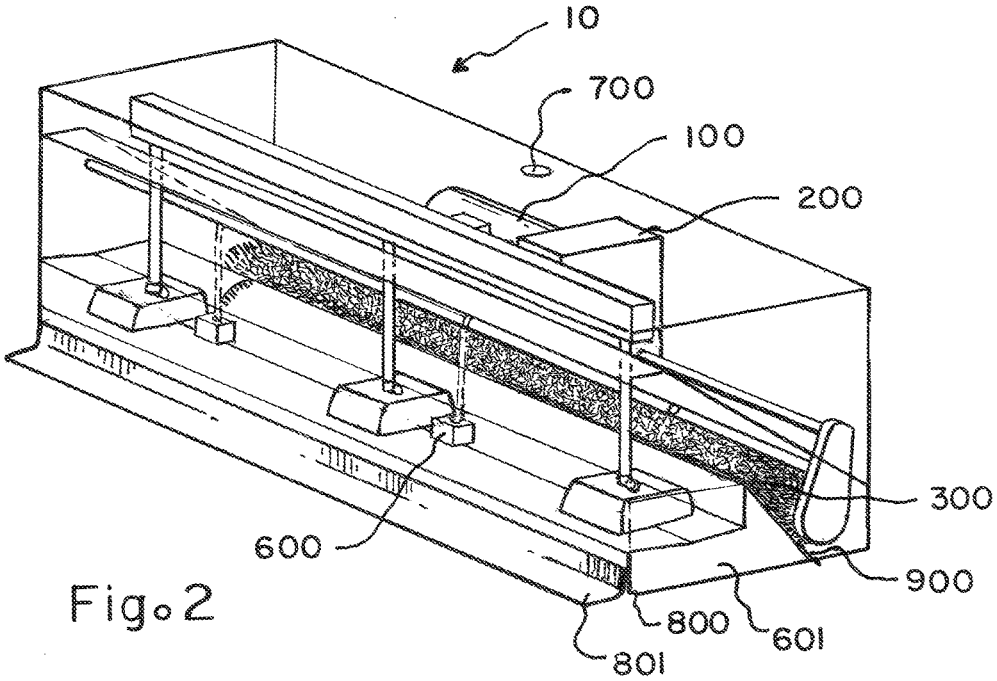
FIG. 2 is an isometric top side view of the device, according to the present invention.
Figure 3:
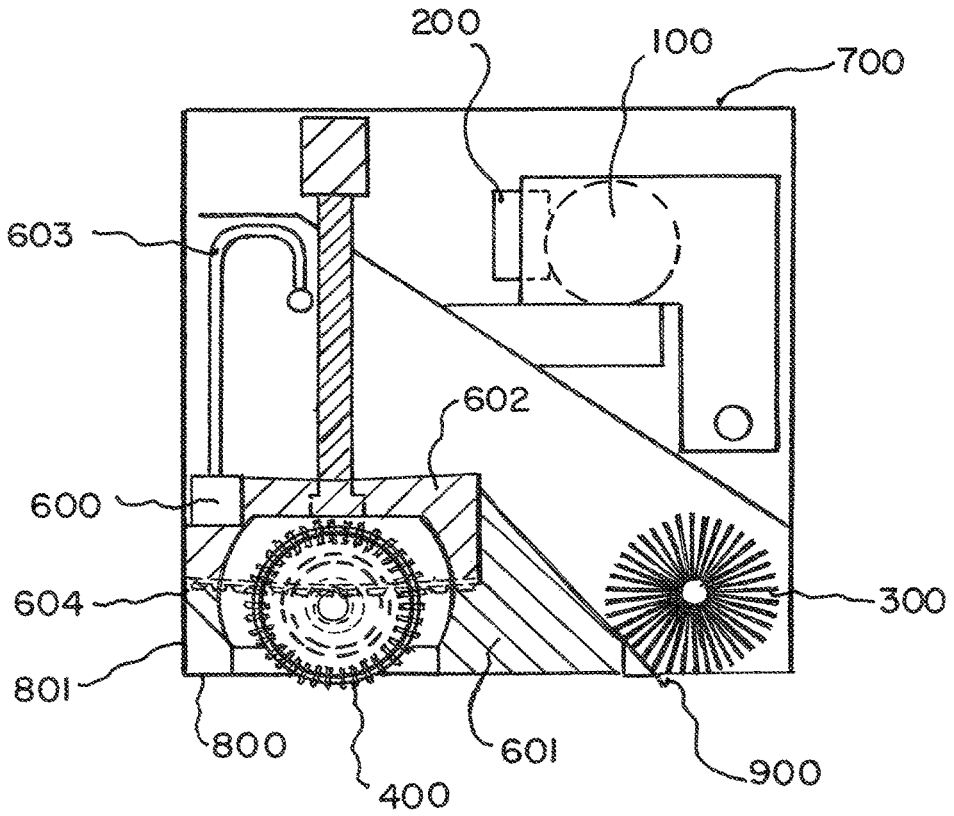
FIG. 3 is side view of the internal components of the device, according to the present invention.

Referring now to FIG. 1-3, various views of a self-driven ice-resurfacing device, generally referred to as 10, are shown. In the preferred embodiment of the present invention, the device 10 is comprised of several individual components contained within an exterior housing. The housing extends a width, a length, and a height of the device to enclose the components. These components operate in combination to provide an efficient and effective ice resurfacing by brushing the ice, scraping the ice, heating collected ice shavings to reduce bulk and recycle the ice shavings, filtering the heated ice shavings, and depositing this filtered, heated, and recycled water back onto the ice surface at a smooth and consistent rate of flow. To accomplish this process, these several systems are powered by a motor 100 and a fuel source 200. The fuel source is preferably electric in the form of a battery or batteries, although the fuel source could be any standard low emissions fuel such as propane, natural gas, hydrogen, or even provided by plugging into a standard electric household current.

This fuel source 200 and motor 100 will power all of the systems of the device 10. The major mechanical systems of the device will be a brush 300, drive wheels 400, heating elements 500, water pump 600, navigation controls 700, and watering unit 800. In addition to the mechanical systems, the device 10 includes a blade 900, a water filter unit 604, and a pair of water storage tanks; one containing warm water 601 and one containing hot water 602.

The device is movable across and onto the ice surface via the drive wheels 400. In the preferred embodiment of the present invention, at least three drive wheels 400 are movable and powered by the motor 100. Although the motor is preferred, it is anticipated that the wheels could be powered by individual motors or a rotary motor located within a hub of the wheels. Preferably, the wheels are located near a rear of the device and below the water storage tanks 601 and 602 to support the weight of the device 10 and equally spaced across the width of the device 10. The wheels may include studded tires to provide traction to the device as it navigates the ice surface.

A front of the device will include the brush 300. The brush 300 is cylindrical and rotates in clockwise direction along a width of the device 10. The brush 300 includes a plurality of stiff bristles to contact the ice surface and sweep snow off of the ice and to move it towards the water storage tanks 601 and 602 and rear of the device 10.

The blade 900 is located adjacent to the brush 300 opposite the font of the device and includes a leading edge to scrape the ice surface. The blade 900 is mounted in an angular fashion to be in frictional communication with the ice surface to shave and scrape worn ice. The depth of the blade can be adjusted to cut deeper into the ice surface.

The blade 900 is mounted on the warm water tank 601. The warm water tank 601 has an exterior with an angular shape in line with the leading edge of the blade 900 and aligned with the brush 300, wherein the angular shape acts as a modified incline plane to move snow off of the ice surface and into the hot water tank 602. The hot water tank 602 is positioned adjacent and on top of the warm water tank 602 and includes an opening to receive ice shavings. The warm water tank 601 contains water to be placed onto the ice surface for resurfacing. In the preferred embodiment of the present invention, the warm water tank will have a capacity of approximately ninety-one (91) gallons and maintains water at a temperature of one hundred-sixty degrees Fahrenheit (160° F.). A thermostat and a water heater maintain this preferred temperature.

Preferably, the hot water tank 602 has a capacity of approximately sixty-three (63) gallons and maintains water at a temperature of two hundred-ten degrees Fahrenheit (210° F.). The high temperature of the hot water tank 602 aids in melting snow as it is added to the hot water tank 602. The hot spray of water from a nozzle 603 powered by the water pump 600 furthers melting. As snow enters the hot water tank 602, the nozzle 603 delivers a steady spray of hot water to melt the snow, which is deposited into the hot water tank 602.

Water is moved from the hot water tank 602 to the warm water tank 601 to allow for the regulation of the temperature and replenish water into the warm water tank 601 used for resurfacing. To facilitate clean water, a water filter 604 is located inline with the connection between the hot water tank 602 and warm water tank 601, wherein hot water is filtered prior to entering into the warm water tank 601. The water filter 604 can remove impurities, debris, and particulates generated from the melted snow deposited into the hot water tank 602.

Water exiting the warm water tank 601 will be placed on the ice with the watering unit 800. The watering unit 800 will evenly distribute warm water onto the ice at the rear of the device 10. The flow of water placed onto the ice is controlled and further distributed with a trailing mat 801. Preferably, the watering unit contains a plurality of apertures extending the width of the device and utilizes a flow meter and gravity to control the flow of water from the watering unit and warm water tank 601 onto the ice surface.

The directional control and location of the device 10 on the ice surface is controlled by the internal electronic components of the device in communication with the navigation controls 700. Preferably, the device will utilize the global positioning system (GPS) to navigate the ice surface, although the various patterns can be directly programmed into the device 10, the device 10 could follow an indicator placed above or below the ice surface, or the device 10 could be remote controlled by a user.

To better understand the operation of the device 10, it's easiest to discuss the various components and there co-operation in the process of resurfacing a sheet of ice. During various activities on ice, such as skating, the ice begins to degrade and ice shavings, or snow as it is sometimes called, builds up on the surface of the ice. To provide a smooth ice surface this snow needs to be removed and new water applied to the ice surface.

In use, the device 10 will enter the ice surface using the wheels 400 and aligning itself perpendicularly with the length of the ice sheet. The wheels 400 are movable in multiple directions and driven by the motor 100 to facilitate this movement. The device 10 will then travel around the perimeter of the ice sheet in a pattern to resurface worn ice. As the device 10 travels, the brush 300 will clean the ice prior to the blade 900 scraping the ice, with the brush 300 and shape of the warm water tank 601 helping to move snow into the hot water tank 602. Simultaneous to the brushing and scraping, snow will enter the hot water tank 602 where it is melted with the nozzle 604 and filtered and transferred to the warm water tank 601 as need. Additionally, the watering unit 601 will be depositing fresh water onto the ice. As the device 10 moves around the rink, snow will be continuously melted and added to the hot water tank 602 and recycled into the warm water tank 601.

Figure 4:
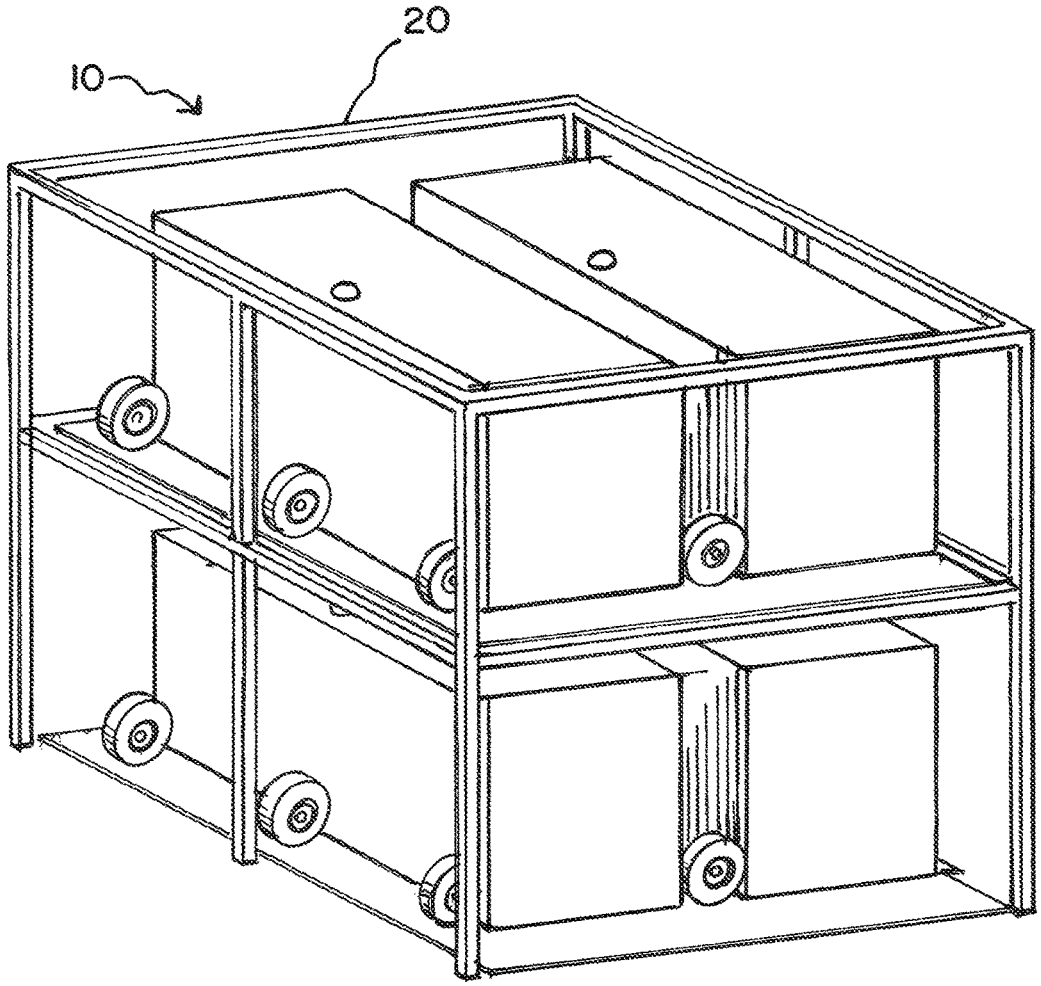
FIG. 4 is an isometric view of the device as stored on a rack, according to the present invention.
Figure 5:
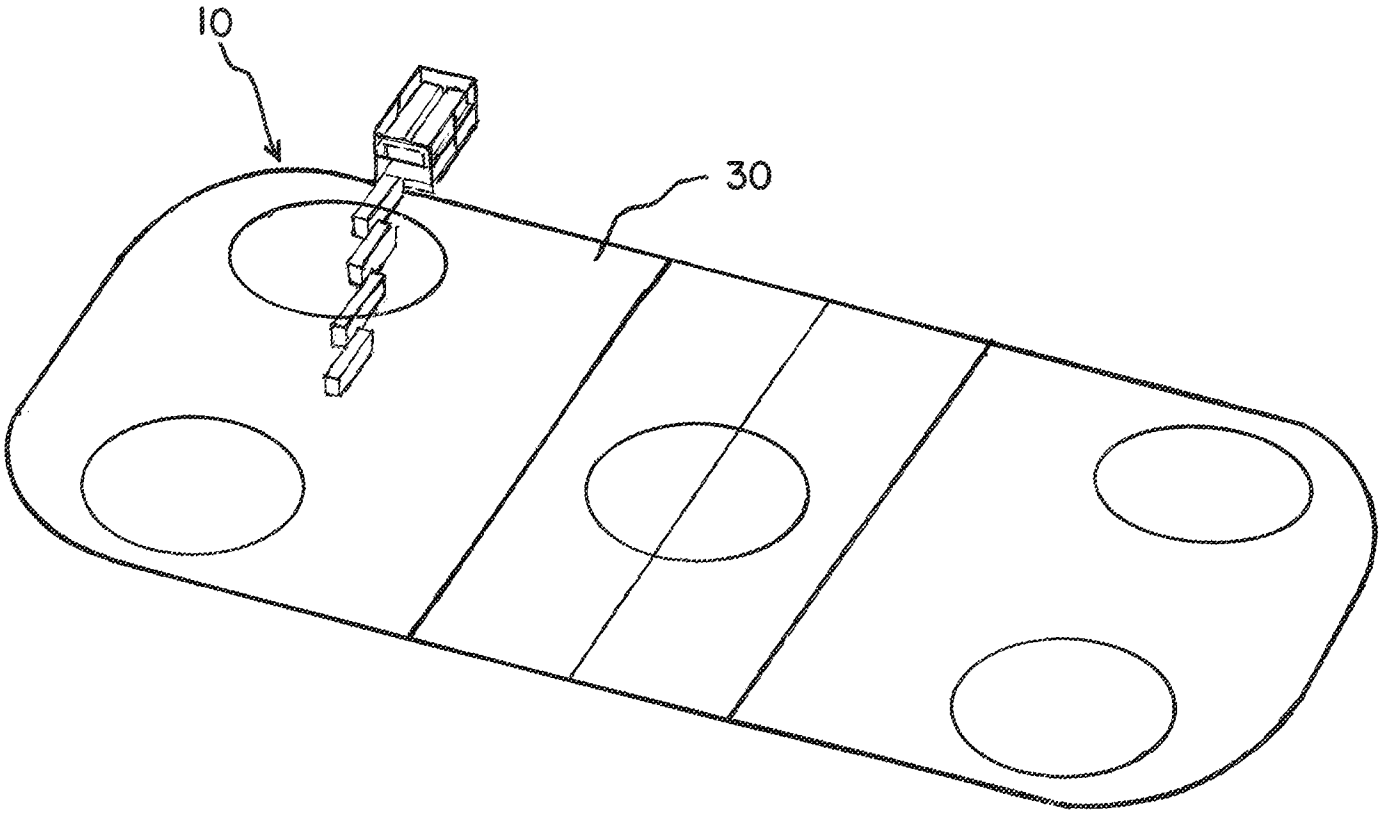
FIG. 5 is an isometric view of the devices as used on an ice rink, according to the present invention.

In the preferred embodiment, multiple devices 10 will be used in tandem to resurface the ice quickly. In the preferred embodiment, as shown in FIG. 5 of the present invention, four devices 10 are used at a time to resurface the ice 30 within a couple of minutes. Accordingly, the devices are sized to be installed into existing infrastructure, such as bays and garages, for quick entry onto and off of the ice surface. Preferably, as shown in FIG. 4 the devices 10 are stored on a rack 20 and quickly moved into position on the ice. In this configuration, four devices 10 will in tandem complete one lap around the rink 30 to complete an entire resurfacing.

Accordingly, the preferred materials used on the device 10 are corrosion resistant and resilient with the preferred material stainless steel, although other similar materials may be used. The preferred size of the device 10 is an operational width of eleven (11) feet and a depth of approximately three (3) feet. This allows for storage of multiple devices 10 within existing infrastructure. Although, the use of multiple devices 10 is preferred for quick resurfacing, one device 10 does have the capacity and capability to resurface an entire hockey rink.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A method of resurfacing an ice rink with a self driven ice resurfacing device, the self driven ice resurfacing device including a blade, a brush positioned adjacent to the blade, a first water tank for the receipt of shaved ice, a second water tank receiving water from the first water tank, and a watering unit, the method comprising:

programming the device to enter the ice rink at a given command;

giving the command for the device to enter the ice rink; and the device entering the ice rink, engaging the blade and the brush with the ice surface and completing several programmed laps to resurface the ice rink, wherein the blade and brush are adapted to scrape and remove worn ice and deposit shaved ice into the first water tank and deposit water from the second water tank onto the ice with the watering unit.

2. The method as in claim 1, wherein at least two devices are programmed to enter the ice rink.

3. The method as in claim 1, wherein at least three devices are programmed to enter the ice rink.

4. The method as in claim 1, wherein at least four devices are programmed to enter the ice rink.

* * * * *